US005946530A

United States Patent [19]

Tsuji et al.

[11] Patent Number: 5,946,530

[45] Date of Patent: Aug. 31, 1999

[54] DEVELOPER PROCESSING APPARATUS PROVIDED WITH SEALING MEMBER AND SEALING LAYER AT ROTARY MEMBER SUPPORTING PORTION

[75] Inventors: Masahiro Tsuji, Nara; Yoshiki Ichikawa, Kashihara; Takashi Miyaji, Nara; Shigeru Yamaguchi, Yamatokoriyama; Takahiko Kimura, Ikoma; Jun Yamaguchi, Ikoma, all of Japan

[73] Assignee: Sharp Kabushiki Kaisha, Osaka, Japan

[21] Appl. No.: 09/104,195

[22] Filed: Jun. 25, 1998

[30] Foreign Application Priority Data

Jul. 23, 1997 [JP] Japan ..... 9-196787

[51] Int. Cl.[6] ..... G03G 15/08

[52] U.S. Cl. ..... 399/103; 399/105; 399/106

[58] Field of Search ..... 399/103, 105, 399/106, 343, 357; 384/130, 138–140, 151; 277/345, 352, 353

[56] References Cited

U.S. PATENT DOCUMENTS

| | | | |
|---|---|---|---|
| 4,842,423 | 6/1989 | Bhagwat | 384/130 |
| 5,166,731 | 11/1992 | Aimoto et al. | 355/215 |
| 5,170,212 | 12/1992 | Dececca | 355/245 |
| 5,267,007 | 11/1993 | Watanabe et al. | 355/245 |
| 5,287,148 | 2/1994 | Sakemi et al. | 355/245 |
| 5,450,169 | 9/1995 | Hart et al. | 355/215 |
| 5,541,710 | 7/1996 | Stewart et al. | 355/215 |
| 5,805,958 | 9/1998 | Fisk | 399/98 |

FOREIGN PATENT DOCUMENTS

| | | |
|---|---|---|
| U3-20356 | 2/1991 | Japan . |
| A3-189666 | 8/1991 | Japan . |

*Primary Examiner*—Richard Moses

[57] ABSTRACT

A developer processing apparatus includes a rotary member provided rotatably in a container containing the developer, a sealing member provided at the rotary member and being brought into pressure contact with a portion supporting the rotary member and a sealing layer provided at the portion where the sealing member is brought into pressure contact, and formed of a material having lower hardness than the sealing member.

8 Claims, 5 Drawing Sheets

DEVELOPER PROCESSING APPARATUS PROVIDED WITH SEALING MEMBER AND SEALING LAYER AT ROTARY MEMBER SUPPORTING PORTION

BACKGROUND OF THE INVENTION

1. Field of the Invention

The present invention relates to a developer processing apparatus for supplying or stirring a developer. More specifically, the present invention relates to a developer processing apparatus having a sealing member and a sealing layer provided at a portion rotatably supporting a member for supplying or stirring the developer.

2. Description of the Background Art

In an image forming apparatus employing electrophotography such as a copying machine or a printer, a developing apparatus is provided for forming a latent electrostatic image on a surface of a photoreceptor as a recording medium, supplying a developer such as toner for measuring the latent image to the surface of the photoreceptor and for applying the developer on the image.

In the developing apparatus, the latent electrostatic image formed on the surface of the photoreceptor is developed, and the developed toner image is transferred onto a transfer material such as a sheet of paper. After the toner image is transferred, part of the toner which has not fully been transferred is left on the surface of the photoreceptor. The residual unnecessary toner is removed from the surface of the photoreceptor so as to form next image repeatedly. Therefore, a cleaning apparatus for removing the toner left on the surface of the photoreceptor after transfer is provided, and the unnecessary toner removed by the cleaning apparatus is put in a container unit in the cleaning apparatus.

As described above, conventionally, a developing apparatus for developing the latent electrostatic image formed on the surface of the photoreceptor and a cleaning apparatus for removing the toner left on the surface of the photoreceptor have been provided, and by these apparatuses, the toner in the form of fine particles must be processed. In order to process the toner as a developer, a rotary member is provided in a container forming part of the developing apparatus or the cleaning apparatus, that is, a developer tank in the developing apparatus and a toner container unit in the cleaning apparatus, for supplying and processing the toner.

The rotary member provided for the developing apparatus includes a stirring member for stirring the developer in the developer tank, and a supply member for supplying the developer to the photoreceptor. A rotary member which is rotary driven for supplying and stirring the developer is also provided at a member for supplying toner to the developer tank. These members constitute the developer processing apparatus.

Further, in the cleaning apparatus, a supply member for feeding toner contained temporarily in the container unit to the recovery container, for example a screw member, is provided as a rotary member. Rotary member and the toner container unit are components of the developer processing apparatus.

The aforementioned rotary members are rotatably supported at the toner container unit of the cleaning apparatus or at the developer tank constituting the developing apparatus. Therefore, it is possible that fine powder of toner enters the supporting portion supporting the rotary member, causing failure in rotation.

Japanese Patent Laying-Open No. 3-189666 discloses a conventional technique for supporting the rotary member. In this technique, a sealing member (such as a V ring) formed of rubber, for example, is provided for sealing the portion supporting the shaft of the rotary member, so as to prevent entrance of powder, such as toner, to the supporting portion.

Japanese Utility Model Laying-Open No. 3-20356 proposes a technique in which a sealing member formed of stainless steel, for example, is provided at the portion supporting the shaft of the rotary member, and an edge (bellows) of a V ring having a V shaped groove is brought into pressure contact with the sealing member for tight sealing, whereby entrance of the fine powder such as toner to the bearing portion is prevented.

According to the prior art described above, in a developing apparatus including a toner supply unit or in a developer processing apparatus provided at the cleaning apparatus, the rotary member for stirring or supplying the developer is rotatably supported by a supporting unit provided in a container containing the developer, and entrance of the developer at the supporting portion is effectively prevented. Accordingly, failure in rotation caused by the entrance of the developer is prevented.

However, generally, resin material, which is easy to mold and inexpensive is generally used for the developer tank and the container unit of the cleaning apparatus for supporting the rotary member as well as a screw roller, for example, serving as the rotary member for supplying or stirring the developer. Metal material such as aluminum or stainless steel is commonly used for the shaft for rotating the screw roller and the support portion, in view of strength and durability.

The screw roller as a resin molded rotary member mentioned above is charged by friction while it supplies the developer, and by the charges, a potential of several hundreds to several thousands volts is generated at the surface of the resin member. This causes an electric field between the resin member and the shaft or supporting member rotatably supporting the rotary member, so that charge developer adheres and coagulates on the shaft and supporting member. Therefore, even when the above described member for preventing entrance of the prior art is provided, the developer unavoidably enters the support portion after long time of operation, possibly causing failure in rotation.

Referring to FIGS. 1A and 1B, for example, when rotary member 5 rotates, the container 3 itself or a vane 5*a* of the rotary member 5 is charged positive by friction with the developer contained in the container 3. Charges of opposite polarity comparable to the charges are induced on a conductive rotary shaft 50, whereby an electric line of force runs therebetween, generating an electric field. The toner, which is the developer 2 charged along the electric field, especially along the electric line of force adheres on the rotary shaft 50 and is coagulated gradually. Therefore, even when sealing member (V ring) 53 is provided, developer 2 gradually enters the bearing unit 52.

SUMMARY OF THE INVENTION

An object of the present invention is to provide a developer processing apparatus which surely prevents entrance of the developer to the bearing portion by the rotation of the rotary member.

According to an aspect of the present invention, the developer processing apparatus includes a rotary member rotatably provided in a container containing the developer, a sealing member provided at the rotary member and is brought into pressure contact with a portion where the rotary member is supported, and a sealing layer provided at the portion where the sealing member is brought into pressure contact and formed of a material having lower hardness than the sealing member.

Since the sealing layer has lower hardness than the sealing member, the sealing layer is abraded by the sealing member, whereby air tightness attained by the sealing member and the sealing layer is increased, thereby effectively preventing entrance of the developer to the bearing portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The developer processing apparatuses in accordance with various embodiments of the present invention will be described in the following. Specifically, a rotary member provided at a developing apparatus will be described as an example. Application of the present invention is not limited to the developer apparatus and it may be similarly applicable to any portion for supplying or stirring the developer.

Figure 1A:
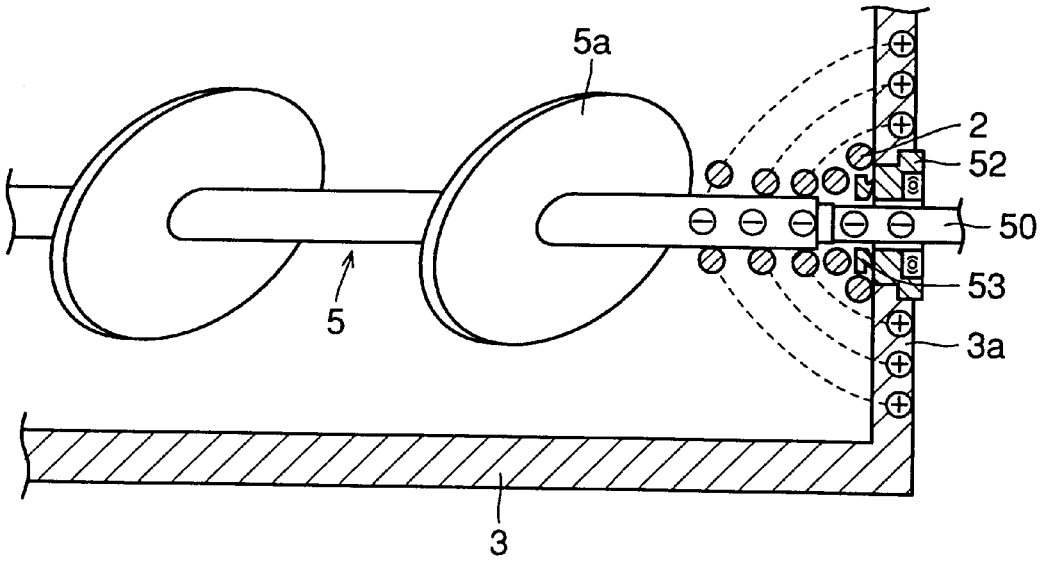
FIG. 1A PRIOR ART
FIGS. 1A and 1B are illustrations showing a process of entrance of the developer to a rotary member supporting portion in a conventional developing apparatus.
Figure 1B:
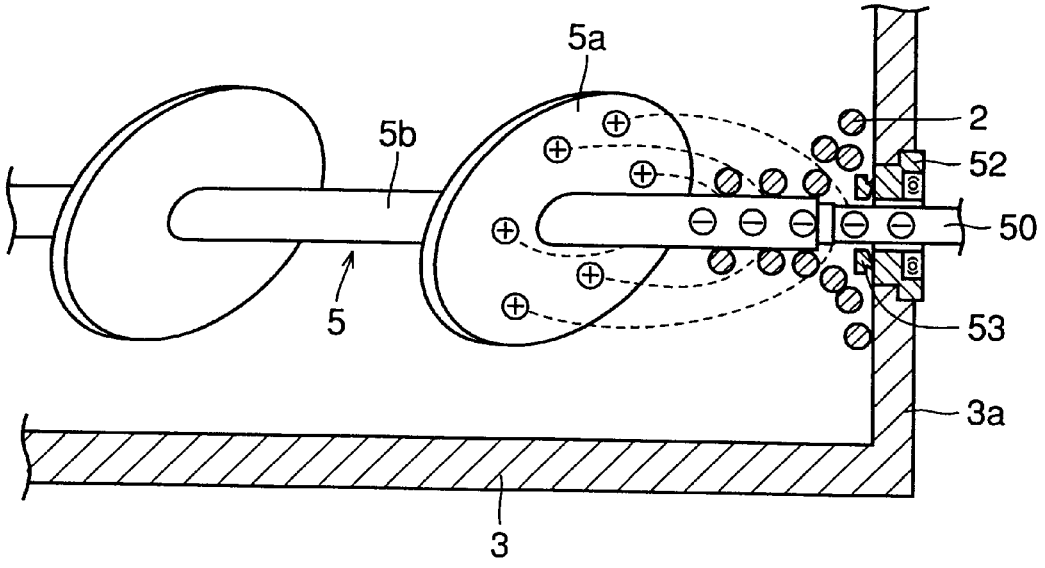
FIG. 1B PRIOR ART
Figure 2:
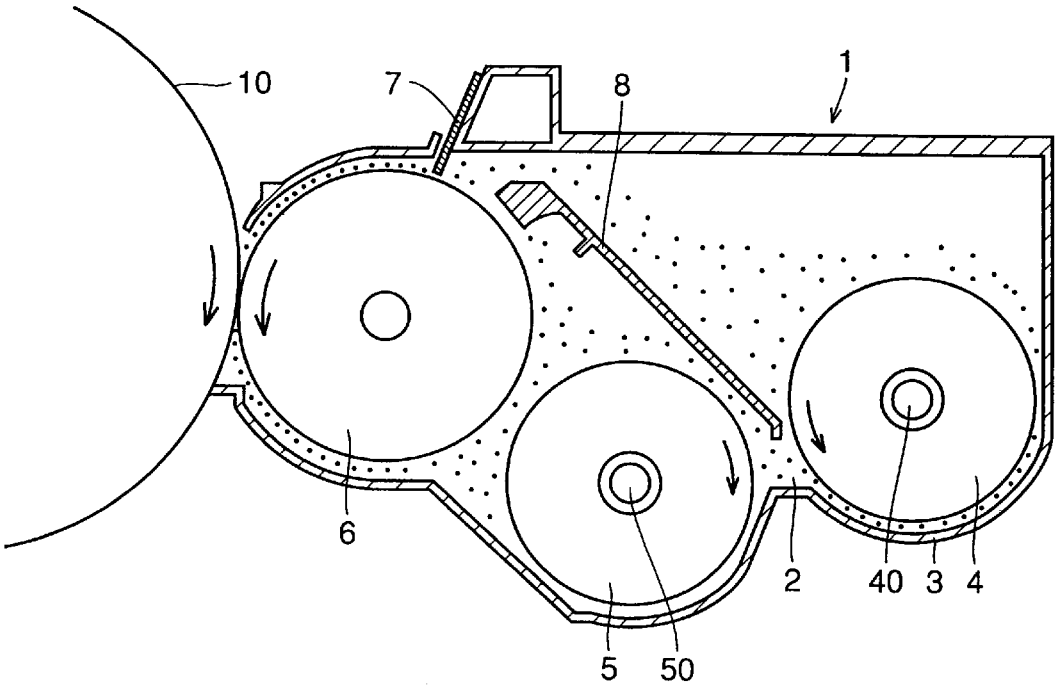
FIG. 2 is a cross section showing an exemplary structure of the developing apparatus in accordance with the present invention.

Referring to FIG. 2, a developing apparatus 1 includes a developer tank 3 as a container for containing developer 2, formed by resin molding. In developer tank 3, there are provided stirring and supplying rollers 4 and 5 for supplying and stirring developer 2, and a developing roller 6 for magnetically attracting and feeding developer 2 supplied by stirring and supplying roller 5, provided rotatably. As is well known conventionally, developing roller includes a cylindrical non-magnetic sleeve covering a number of magnets provided on an inner peripheral surface, and the roller is driven to rotate in the direction of the arrow. Therefore, developer 2 is attracted by the magnetic force by the magnets to the surface of the sleeve, and supplied along the direction of rotation of the sleeve.

Developing roller 6 is provided with a portion thereof exposed from an opening of developer tank 3, and the roller opposes to a photoreceptor 10 which is also rotated, at the exposed portion. This opposing position is a developing position, where developer 2 supplied by the rotation of developing roller 6 is brought into frictional contact with the latent electrostatic image formed on the surface of photoreceptor 10, whereby the toner adheres on the latent electrostatic image. For example, the toner, which has been charged by friction, is attracted by the electrostatic force of the latent image, and is developed.

Before developer 2 is supplied to the developing position for frictional contact with photoreceptor 10, excessive developer 2 attracted to developing roller 6 is removed by a doctor blade 7 so that the developer amount is always kept constant. The developer 2 removed from developer roller 6 is fed again between stirring and supplying rollers 4 and 5 along a guide plate 8 extending to the rollers 4 and 5.

Developer 2 includes two components developer containing carrier and toner, and one component developer containing toner only. The one component developer includes magnetic developer and non-magnetic developer. The non-magnetic one component toner is not attracted to the surface of developing roller 6 by the magnetic force. However, it can be attracted to the surface of developing roller 6 and supplied utilizing frictional charge. In such a case, a rubber member is often used for developing roller 6.

By the above described structure, developer 2 in developer tank 3 is sufficiently stirred by stirring and supplying rollers 4 and 5, and developer 2 is charged to a prescribed polarity, for example, positive. The charged developer 2 is supplied to developing roller 6 by the function of stirring and supplying roller 5, attracted magnetically, for example, to developing roller 6, and is fed to the developing position, while the amount of developer 2 is adjusted to be constant by doctor blade 7. Developer 2 removed by doctor blade 7 is returned along guide plate 8 to be fed between stirring and supplying rollers 4 and 5, and the developer 2 is again stirred and supplied.

Developer 2 left after development is supplied to developer tank 3, scraped off from developing roller 6, stirred by stirring and supplying rollers 5 and 4 and again used for development. In this manner, stirring and supplying rollers 4 and 5 as well as developing roller 6, which are rotary members, are rotated, causing friction with developer 2, so that stirring and supplying rollers 4 and 5, developer tank 3 and so on are charged. However, since developing roller 6 has a cylindrical sleeve which is commonly formed of a conductive metal material, developing roller 6 does not much suffer the problem of charging.

By contrast, stirring and supplying rollers 4 and 5 are generally formed by resin molding, and shafts 40 and 50 for rotating rollers 4 and 5 are formed of metal material. Therefore, when rollers 4 and 5 are driven to rotate, the rollers are charged by friction, and the potential of charging increases gradually. Consequently, developer such as the toner and the carrier is attracted to shafts 40 and 50 near the bearing portion of developer tank 3 rotatably supporting shafts 40 and 50, and the developer gradually enters the bearing portion by rotation. Though a sealing member (V ring 53) is provided for preventing entrance of developer 2 to the bearing portion, the developer may possibly enter the bearing portion through the sealing member.

(First Embodiment)

Figure 3:
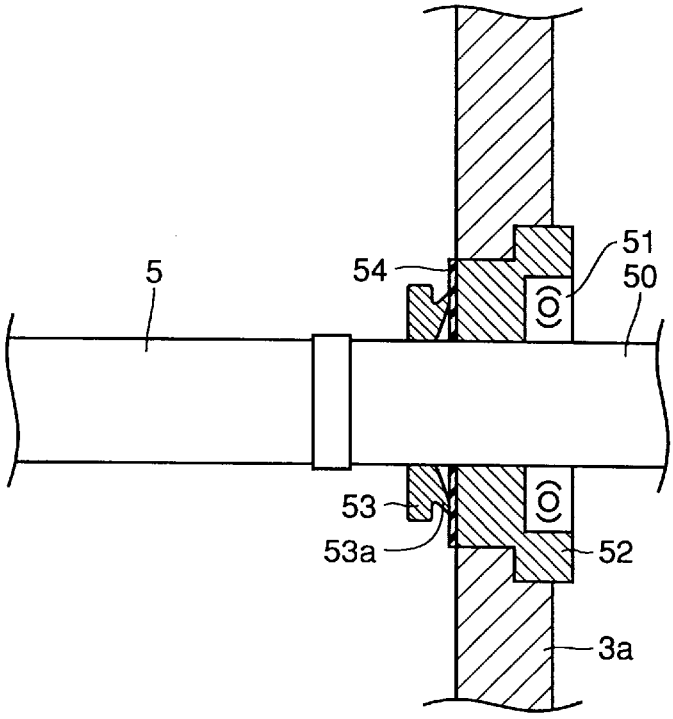
FIG. 3 is a cross section of a portion supporting the rotary member in a developing apparatus in accordance with a first embodiment of the present invention.

FIG. 3 shows, as an example, stirring and supplying roller 5 provided as the rotary member. Stirring and supplying roller 4 has the same structure, and the characteristic feature of the present invention described in the following is applicable to stirring and supplying roller 4.

Stirring and supplying roller 5 as a rotary member has rotary shaft 50 having opposing ends formed of metal, for example, and rotary shaft 50 is rotatably supported by a bearing holder 52 on which a ball bearing 51 is attached, provided at a sidewall 3*a* of developer tank 3. Bearing holder 52 is for holding bearing 51, and provided at a sidewall 3*a* of developer tank 3.

Stirring and supplying roller 5 formed by resin molding is fixed covering one rotary shaft 50, for example. Alternatively, metal rotary shafts 50 may be attached on opposing ends of a roller. A driving gear or the like, not shown, is fixed on one side of rotary shaft 50 that is protruding from developer tank 3. In order to prevent entrance of developer 2 between bearing holder 52 and rotary shaft 50, a V ring 53 as a sealing member is fixed on rotary shaft 50.

V ring 53 is for preventing entrance of developer 2 between bearing holder 52 and rotary shaft 50 by mechanical pressure contact on bearing holder 52, and the ring is provided such that an edge 53*a*, which is elastically deforms, is brought into pressure contact with an inner surface of sidewall 3*a* of developer tank 3, that is, one surface (pressure contact surface) of bearing holder 52.

Sealing member 53 is formed of rubber, for example, and fixed on rotary shaft 50 such that edge 53*a* thereof is brought into pressure contact with the pressure contact surface of bearing holder 52 by the elasticity of itself. Therefore, as rotary shaft 50 rotates, one end of V ring 53 is brought into frictional contact with bearing holder 52, preventing entrance of developer 2 between bearing holder 52 and rotary shaft 50.

V ring 53 as the sealing member has a ring shape with a groove so that its cross section has a V shape. The edge of the ring is formed as bellows, and the edge is brought into pressure contact by the elasticity of bellows 53*a* itself with the pressure contact surface of bearing holder 52. Rotary shaft 50 is inserted through and fitted in a central opening of V ring 53, whereby the ring is fixed on rotary shaft 50.

In the above described structure, on the pressure contact surface of bearing holder 52 with which edge 53*a* of V ring 53 is brought into pressure contact, sealing layer 54 is provided. Sealing layer 54 is formed of a material having lower hardness than V ring 53.

V ring 53 is formed of a material such as BAYTON rubber or neoprene rubber having hardness of about 80 (according to JIS K6301 hardness test A type). Sealing layer 54 is formed of a material having lower hardness than V ring 53, for example, a resin having hardness of about 50 to about 55. Sealing layer 54 is formed by applying the resin on the pressure contact surface of bearing holder 52 by sintering, for example. Sealing layer 54 is formed by applying and sintering engineering plastics containing fluoride resin mixed by about 10% with a solvent such as polyether sulfon, for example.

Figure 4:
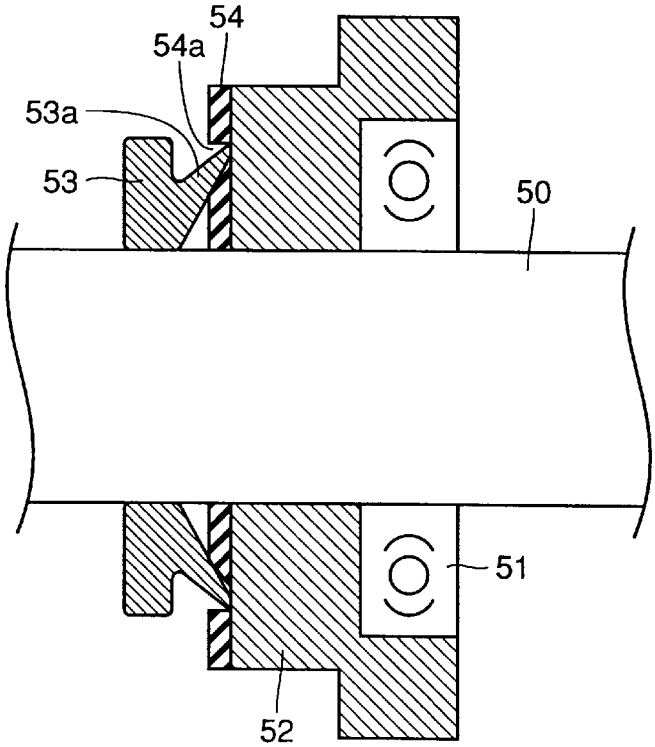
FIG. 4 is an enlarged cross section of the portion supporting the rotary member shown in FIG. 3.

In the above described structure, when rotary member 5 rotates, V ring 53 as the sealing member fixed on rotary shaft 50 is brought into frictional contact with the opposing ends of developer tank 3, that is, the pressure contact surface of bearing holder 52. As the operation is repeated, edge 53*a* of V ring 53 gradually abrades sealing layer 54 of the pressure contact surface, whereby a ring shaped groove 54*a* is formed as shown in the enlarged view of FIG. 4. Pressure contact edge 53*a* of V ring 53 is brought into pressure contact with and fitted in ring shaped groove 54*a*. Thus, air tightness of the space between edge 53*a* of V ring 53 as the sealing member and recessed portion 54*a* of sealing layer 54 is increased.

Therefore, even when stirring and supplying roller 5, wall surface 3*a* of developer tank 3 and so on are charged by the rotation of stirring and supplying roller 5, and developer 2, specially the toner in the form of fine particles is coagulated, entrance of developer 2 between bearing holder 52 and rotary shaft 50 can be prevented, as the air tightness of the space formed by the pressure contact edge 53*a* of V ring 53 and sealing layer 54 is increased.

As an example, an engineering plastic mentioned above having the hardness of about 50 to about 55 (according to JIS K6301 hardness test A type) was applied on the pressure contact surface of the sealing member at the bearing holder 52 provided on an inner wall of developer tank 3 of developing apparatus 1, and the engineering plastic was sintered to form sealing layer 54, as shown in FIG. 3. V ring 53 to be brought into pressure contact with sealing layer 54 was formed by BAYTON rubber (or neoprene rubber) having the hardness of 80, and stirring and supplying roller 5 was driven to rotate at a speed of rotation for development. More specifically, the speed of rotation was 400 rpm (generally, the speed of rotation is set to be about 300 to about 400 rpm) for the test.

Even after continuous operation of more than 100 hours, entrance of developer 2 to the contact portion between bearing holder 52 and rotary shaft 50 was not observed, and thus the effect of the invention was confirmed.

Generally, developing apparatus 1 operates during image formation, and stirring and supplying rollers 4 and 5 are driven to rotate. When image forming operation is completed, operation is stopped and rotation of rollers 4 and 5 is also stopped. Therefore, continuous operation for 100 hours is not expected for the image forming apparatus. However, even under such severe operating condition, entrance of developer 2, specially entrance of the toner, can be prevented by the apparatus of the present invention.

After the lapse of two to three hours of continuous rotation of stirring and supplying roller 5, the temperature of the pressure contact portion increased to about 50° C., and thereafter, the temperature was not increased further. Namely, that was the saturating temperature and at which the toner was not melt.

(Second Embodiment)

In the first embodiment above, a sealing layer 54 has been described. For further enhancing the effect of sealing, in the second embodiment, sealing layer 54 has a two-layered structure as shown in FIG. 5.

Figure 5:
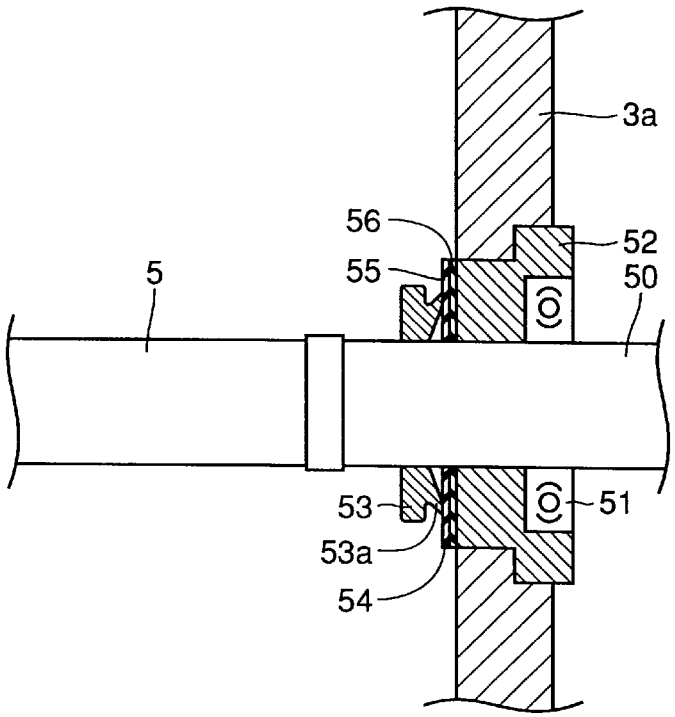
FIG. 5 is a cross section of a portion supporting the rotary member in a developing apparatus in accordance with a second embodiment of the present invention.

Referring to FIG. 5, sealing layer 54 includes a first sealing layer 55 with which edge 53*a* of V ring 53 is brought into pressure contact, and a second sealing layer 56 provided between the first sealing layer 55 and the pressure contact surface of bearing holder 52.

Second sealing layer 56 is formed of a material having sufficient hardness not to be abraded by V ring 53, that is, a material such as resin having higher hardness than V ring 53. First sealing layer 55 is formed of the same material as sealing layer 54 described in the first embodiment. That is, the first sealing layer 55 is formed of a material such as resin having lower hardness than V ring 53.

The second sealing layer 56 is formed by applying by sintering the resin of the above described hardness on the pressure contact surface of bearing holder 52, and the first sealing layer 55 is formed in the similar manner, by applying by sintering the resin of the above described hardness on the first layer, whereby the sealing layer 54 is completed.

When stirring and supplying roller 5 is driven and rotated, V ring 53 is brought into pressure contact and slides over sealing layer 54 provided on the pressure contact surface of bearing holder 52. Accordingly, the first sealing layer 55 of the sealing layer 54 is gradually abraded by the pressure contact edge 53*a* of V ring 53. As can be seen from the enlarged view of FIG. 6, ring shaped groove 55*a* is formed, and the pressure contact edge 53 is brought into pressure contact with and fitted in the ring shaped groove 55*a*. Accordingly, the sealing layer 54 is not further abraded with the edge 53*a* of V ring 53 as the sealing member being in pressure contact with the second sealing layer 56, and the stable state is maintained. More specifically, the pressure contact state between the pressure contact edge 53*a* and the second sealing layer 56 is attained, improving air tightness.

More specifically, since the edge 53*a* of V ring 53 is fitted in the ring shaped groove 55*a* of the first sealing layer 55 of sealing layer 54 to be in pressure contact with the second sealing layer 56, air tightness of the space formed between the V ring 53 and sealing layer 54 is improved.

Therefore, even when stirring and supplying roller 5, wall surface 3*a* of developer tank 3 and so on are charged by the rotation of stirring and supplying roller 5, and developer 2, specially the toner in the form of fine particles is coagulated, entrance of developer 2 between bearing holder 52 and rotary shaft 50 can surely be prevented, as air tightness of the space between V ring 53 and the sealing layer 54 is superior.

As an example, sealing layer 54 was formed in the following manner. Namely, a resin material prepared by solving an engineering plastic suitable for alcoholic solvent, for example, having the hardness of 100 (according to JIS K6301 hardness test A type) was applied as an undercoat, cured and dried on a surface of the inner wall of developer tank 3 of developing apparatus 1 where sealing member 53 of bearing holder 52 was to be brought into contact, and in this manner, the second sealing layer 56 was formed. On the upper surface of the second sealing layer 56, an engineering plastic described in the first embodiment having the hardness of about 50 to 55 was applied by sintering, and thus the first sealing layer 55 was formed. In this manner, the sealing layer 54 was provided. V ring 53 to be brought into pressure contact with sealing layer 54 was formed by BAYTON rubber (or neoprene rubber) having the hardness of 80, for example. The stirring and supplying roller 5 was driven to rotate at the speed corresponding to the speed of actual development, for example, 400 rpm.

Even after continuous operation of more than 100 hours, entrance of developer 2 to the contact portion between bearing holder 52 and rotary shaft 50 was not observed, and the effect of the invention was confirmed.

In this embodiment also, developing apparatus 1 operates in the image forming operation, and stirring and supplying rollers 4 and 5 are driven to rotate. When the image forming operation is completed, the operation is stopped and rotation of stirring and supplying rollers 4 and 5 is also stopped. Therefore, generally, continuous operation of 100 hours is not expected for the image forming apparatus. However, even under such a severe operating condition, entrance of developer 2, especially the toner, can be prevented by the apparatus of the present invention.

As already described in the first embodiment, when stirring and supplying roller 5 or the like was driven and rotated continuously, the temperature at the pressure contact portion was saturated at about 50° C., and the problem of melting of the toner was not experienced.

In the sealing layer 54 in accordance with the second embodiment, the second sealing layer 56 is formed by a material having higher hardness than V ring 53. Superior effects can be expected not only in the apparatus according to the present embodiment but also in the apparatuses in accordance with the following embodiments.

(Third Embodiment)

In the third embodiment, the second sealing layer 56 is formed to have surface roughness smaller than the particle diameter of developer 2, specially, the particle diameter of toner which is fine particles. The first sealing layer 55 used is the same as those described above.

Hardness of the second sealing layer 56 is not specifically limited. It is preferred, however, that the second sealing layer has higher hardness than V ring 53.

The second sealing layer 56 is formed by applying by sintering a resin material having grain diameter of about 5 $\mu$m, for example, on the pressure contact surface of bearing holder 52 shown in FIG. 5, with its surface roughness made finer than the grain diameter of the toner, for example of about 10 $\mu$m. On the second sealing layer 56, a resin material having the hardness lower than the hardness 80 of V ring 53, that is, having the hardness of about 50 to about 55, is formed by sintering, and sealing layer 54 is formed, as described in the second embodiment.

Figure 6:
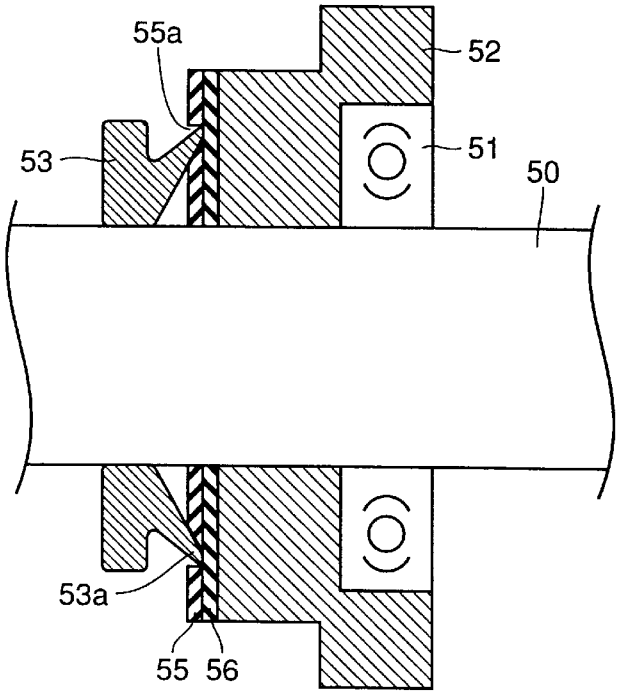
FIG. 6 is an enlarged cross section of the portion supporting the rotary member, shown in FIG. 5.

In this structure also, as stirring and supplying roller 5 rotates, the first sealing layer 55 of sealing layer 54 is abraded by the edge 53*a* of V ring 53, and a ring shaped groove 55*a* is formed as shown in FIG. 6. The edge 53*a* of V ring 53 is fitted in the groove 55*a*, whereby air tightness of the space between V ring 53 and sealing layer 54 is improved, and therefore entrance of developer 2 through V ring 53 can surely be prevented.

With the edge 53*a* of V ring 53 being in pressure contact with the second sealing layer 56, when there is a gap at the pressure contact portion between edge 53*a* and the second sealing layer 56, toner cannot pass through the gap, as the surface roughness of the second sealing layer 56 is finer than the toner particle diameter. Therefore, entrance of developer 2 to the portion between bearing holder 52 and rotary shaft 50 can surely be prevented.

In this embodiment also, even after continuous operation of more than 100 hours of stirring and supplying roller 5 as the rotary member, it was confirmed that entrance of developer 2 to rotary shaft 50 could be prevented.

(Fourth Embodiment)

In the fourth embodiment, the second sealing layer 56 constituting sealing layer 54 in the second embodiment shown in FIG. 5 is formed of a resin material impregnated with a lubricant in itself. The hardness of the second sealing layer 56 is not specifically limited. It is preferred, however, that the hardness is higher than that of V ring 53.

The second sealing layer 56 is formed by applying, by sintering or the like, the resin material impregnated with lubricant therein, on the pressure contact surface of bearing holder 52 shown in FIG. 5. On the second sealing layer 56 formed in this manner, a resin material having the hardness of about 50 to about 55, that is, lower than the hardness 80 of V ring 53, is formed by sintering as described in the second embodiment, and in this manner, sealing layer 54 is completed.

In this structure also, the first sealing layer 55 of sealing layer 54 is abraded by V ring 53 as stirring and supplying roller 5 rotates, a ring-shaped groove 55*a* is formed as shown in FIG. 6, and the edge 53*a* of V ring 53 is fitted in the groove 55*a*. Thus the air tightness of the space between V ring 53 and the sealing layer 54 is improved, and entrance of developer 2 through V ring 53 to rotary shaft 50 can surely be prevented.

With the edge 53*a* of V ring 53 being in pressure contact with the second sealing layer 56, smooth rotation is ensured by the lubricant contained in the second sealing layer 56. Therefore, frictional charging can be suppressed, further enhancing the effect of preventing electrostatic coagulation and entrance of toner.

Further, the ring shaped groove 55*a* formed in the first sealing layer 55 enhances air tightness of the space between V ring 53 and sealing layer 54, preventing entrance of developer 2. Therefore, exudation or backward flow of lubricant in the second sealing layer 56 possibly causing mixture with the toner as the developer 2, can be prevented.

In this embodiment also, even after continuous operation of more than 100 hours of stirring and supplying roller 5 as the rotary member, it was confirmed that entrance of developer 2 to rotary shaft 50 was prevented.

(Fifth Embodiment)

In the fifth embodiment, the sealing member 54 in accordance with the second embodiment shown in FIG. 5 is adapted to include the first sealing layer 55 formed of a resin material difficult to charge, containing a charge control material, and a second sealing layer 56 formed of a heat resistant resin material.

As the second sealing layer 56, the heat resistant resin material having higher hardness than V ring 53 as the sealing member, and the resin material difficult to charge having lower hardness than V ring 53 as the first sealing layer 55, are applied by sintering, for example, on the pressure contact surface of bearing holder 52, and thus the sealing layer 54 is completed.

In this structure, by the charge control function of the first sealing layer 55 itself which is brought into pressure contact with the edge 53*a* of V ring 53, developer 2 electrostatically attracted to the first sealing layer 55 is repulsed. The edge 53*a* of V ring 53 is fitted in the ring shaped groove 55*a* formed by abrasion of the first sealing layer 55, and therefore the effect of sealing developer 2 can further be enhanced. Further, the underlying layer, that is, the second sealing layer 56, is heat resistant, whereby thermal influence can be avoided.

As described above, in the fifth embodiment also, the first and second sealing layers 55 and 56 constituting sealing layer 54 are formed in a stacked manner, by the resin materials mentioned above. Even after continuous operation of more than 100 hours of stirring and supplying roller 5 as the rotary member, it was confirmed that entrance of developer 2 to rotary shaft 50 could be prevented.

In the second to fifth embodiments above, sealing layer 54 has two-layered structure with layers of different materials stacked. It is possible that the sealing layer has multiple layers, for example three or four layers so that air tightness of the space between the edge 53*a* of V ring 53 and the ring shaped groove 54*a* or 55*a* formed by abrasion by the edge 53*a* is improved.

Thickness of sealing layer 54 described in accordance with the first to fifth embodiments will be described.

Sealing layer 54 in the first embodiment, or the first sealing layer 55 constituting the sealing layer 54 in the second to fifth embodiments is abraded by the edge 53*a* of V ring 53, whereby a ring shaped groove 54*a* or 55*a* is formed. Thickness of sealing layer 54 or the like is important to provide satisfactory air tightness in the space between the groove and the edge 53*a* fitted in the groove.

The thickness of sealing layer 54 in the first embodiment, or the first sealing layer 55 of the second to fifth embodiments should preferably be set at least twice and at most three times the grain diameter of developer 2, especially, the grain diameter of the toner (of which average grain diameter is about 10 μm, for example). Assuming that the average grain diameter of the toner is about 10 μm, the sealing layer 54 shown in FIG. 3 or the first sealing layer 55 of FIG. 5 have the thickness of about 20 to about 30 μm.

When the thickness of sealing layer 54 (first sealing layer 55) is smaller than twice the grain diameter of the toner, air tightness attained by fitting of the edge 53*a* of V ring 53 in the abraded ring shaped groove 54*a* (or 55*a*) is not very tight. More specifically, even when the edge 53*a* is fitted in the ring shaped groove 54*a* (or 55*a*), fitting is not very tight. When the thickness of the sealing layer 54 (first sealing layer 55) is larger than third times the grain diameter of the toner, the toner would be filled in the abraded ring shaped groove 54*a* (or 55*a*) by a considerable amount, and bound at that position, whereby possibility of entrance to the portion between bearing holder 52 and rotary shaft 50 through the pressure contact portion with the edge 53*a* is increased.

It has been confirmed by continuous driving of more than 100 hours similar to those described in the first to fifth embodiments that entrance of the developer is surely prevented when the sealing layer 54 or the first sealing layer 55 having the thickness in the range described above is provided.

(Sixth Embodiment)

In the first to fifth embodiment described above, the edge 53*a* of V ring 53 constituting the sealing member, that is, the bellows as a pressure contact member is brought into pressure contact with the sealing layer 54 formed on one surface (pressure contact surface)of bearing holder 52, so as to prevent entrance of developer 2 between bearing holder 52 and rotary shaft 50.

An embodiment having a structure different from the above described embodiments employing sealing layer 54 will be described in the following.

Figure 7:
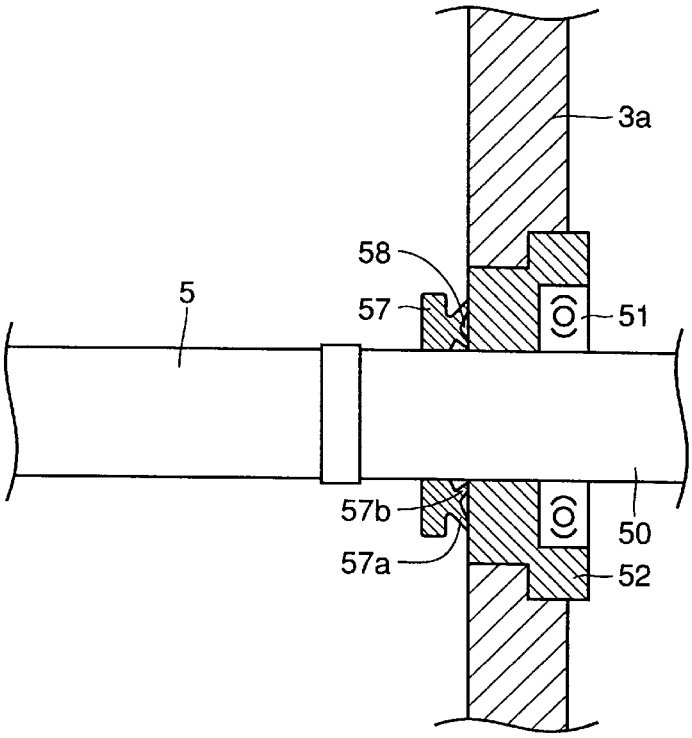
FIG. 7 is a cross section of a portion supporting the rotary member in a developing apparatus in accordance with a sixth embodiment of the present invention.

Referring to FIG. 7, a V ring 57 constituting the sealing member in the sixth embodiment includes at least two edges to be brought into pressure contact with the pressure contact surface of bearing holder 52 provided on the sidewall 3*a* of developer tank 3, that is, at least two bellows as pressure contact members, in order to prevent entrance of developer 2. More specifically, V ring 57 has an outer peripheral bellows 57*a* and an inner peripheral bellows 57*b*, which are in pressure contact with the pressure contact surface of bearing holder 52 by the elasticity. Between bellows 57*a* and 57*b*, a ring shaped recess 59 is formed on the surface opposing to the pressure contact surface of bearing holder 52 so that an appropriate space 58 is formed with the pressure contact surface of bearing holder 52.

Therefore, respective bellows 57*a* and 57*b* of V ring 57 which are formed at different positions at the outer and inner peripheries are brought into pressure contact with bearing holder 52. Therefore, even when developer 2 passes through outer peripheral bellow 57*a*, developer 2 is surely trapped by space 58, and hence further entrance at the pressure contact portion between inner peripheral bellows 57*b* and the pressure contact surface of bearing holder 52 can surely be prevented.

More specifically, when there is not the space 58 formed between bellows 57*a* and 57*b* unlike the present embodiment, the developer 2 which has passed through bellows 57*a* cannot help but goes through the inner peripheral bellows 57*b* and enters the portion between rotary shaft 50 and bearing holder 52. In the sixth embodiment, however, a recess 59 is formed at V ring 57 to provide a space 58 with the pressure contact surface. Therefore, the developer 2 which should have passed through outer peripheral bellow 57*a* can be released at space 58, and surely trapped at the released position. Accordingly, passing through the inner peripheral bellows 57*b* is prevented, and hence entrance to rotary shaft 50 can surely be prevented as a result.

Figure 8A:
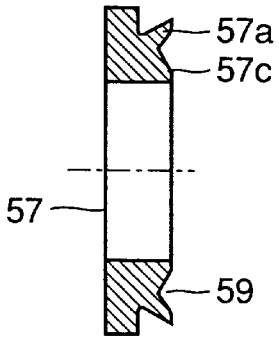
FIGS. 8A to 8C show other examples of sealing members in the developing apparatus in accordance with the sixth embodiment of the present invention.

The shape of V ring 57 is not limited to that of FIG. 7, and similar effects can be obtained when a protrusion 57*c* which is brought into pressure contact with the pressure contact surface of bearing holder 52 is provided separate from outer peripheral bellows 57*a* and a recess 59 is provided between the bellows 57*a* an d 57*c*, as shown in FIG. 8A. By the provision of recess 59, space 58 is ensured with the pressure contact surface of bearing holder 52.

Figure 8B:
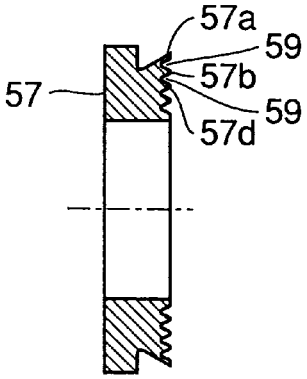
Figure 8C:
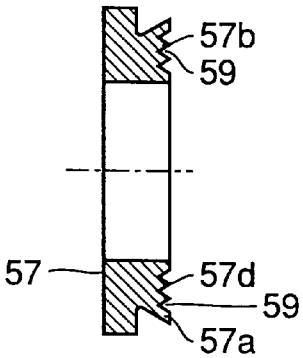

Further, referring to FIGS. 8B and 8C, not only two bellows 57*a* and 57*b* but additional bellows, that is, bellows 57*a*, 57*b*, 57*d* and so on which are brought into pressure contact with the pressure contact surface of bearing holder 52 may be provided, with recess 59 formed to provide space 58 with the pressure contact surface of bearing holder 52 and each of the bellows. In such a case, a plurality of spaces 58 are formed, and therefore the effect of trapping developer 2 at the positions of the spaces 58 can further be enhanced, and therefore entrance of developer 2 is surely prevented.

In FIGS. 8B and 8C, the difference is that the shape of recess 59 formed between the bellows is sinusoidal or triangular, and effects are the same.

In the sixth embodiment, as the bellows provided for the V ring 53 as a sealing member, that is, the portion which is brought into pressure contact with the pressure contact surface of bearing holder 52, a plurality of bellows 57*a* and 57*b*, 57*c*, 57*d* and the like are provided at different positions in radial direction, with the rotary shaft 50 being the center. Utilizing the space 58 formed at that time, developer 2 is surely trapped, to prevent entrance of developer 2 at a portion between rotary shaft 50 and bearing holder 52.

When the above described structure is combined with the structure described in the first to fifth embodiments having sealing layer 54, sealing effect can further be enhanced, and hence the effect of preventing entrance of developer 2 passing through and entering the portion between rotary shaft 50 and bearing holder 52 can further be enhanced.

Developing apparatus 1 has been described as an example of the developer processing apparatus in the embodiments above. However, the present invention is applicable also to a cleaning apparatus having means for removing toner left after the developed toner image is transferred, containing and supplying the removed toner to other toner recovery container. Further, the present invention is applicable not only to the developing apparatus 1 or the cleaning apparatus but also to an apparatus for processing developer 2, for example, a supply apparatus for supplying the developer to developer tank 3.

The present invention is especially effective in preventing entrance of the developer to the portion supporting rotary member, in a developer processing apparatus having a rotary member rotatably provided in a container containing the developer or the like.

Although the present invention has been described illustrated in detail, it is clearly understood that the same is by way of illustration and example only and is not to be taken by way of limitation, the spirit and scope of the present invention being limited only by the terms of the appended claims.

What is claimed is:

1. A developer processing apparatus, comprising:

a rotary member rotatably provided in a container containing a developer;

a sealing member provided at said rotary member and brought into pressure contact with a portion where said rotary member is supported; and a first sealing layer provided at that portion where said sealing member is brought into pressure contact, formed of a material having lower hardness than said sealing member.

2. The developer processing apparatus according to claim 1, wherein said first sealing layer is formed to have a thickness of at least twice and at most three times a grain diameter of the developer.

3. The developer processing apparatus according to claim 1, wherein said sealing member is provided with a plurality of bellows to be brought into pressure contact.

4. The developer processing apparatus according to claim 1, further comprising a second sealing layer provided between said first sealing layer and that portion where said sealing member is brought into pressure contact, and formed of a material having higher hardness than said sealing member.

5. The developer processing apparatus according to claim 4, wherein said second sealing layer is formed of a material having surface roughness finer than a grain diameter of the developer.

6. The developer processing apparatus according to claim 4, wherein said second sealing layer is formed of a material impregnated with a lubricant.

7. The developer processing apparatus according to claim 4, wherein said second sealing layer is formed of a heat resistant material.

8. A developer processing apparatus, comprising:

a rotary member provided rotatably in a container containing a developer; and a sealing member provided at said rotary member and having a plurality of bellows which are brought into pressure contact with a portion supporting said rotary member.

* * * * *